US010676961B2

(12) United States Patent
Weichsel et al.

(10) Patent No.: US 10,676,961 B2
(45) Date of Patent: Jun. 9, 2020

(54) MOTOR VEHICLE LOCK

(71) Applicant: Kiekert AG, Heiligenhaus (DE)

(72) Inventors: Ulrich Weichsel, Duisburg (DE); Ömer Inan, Dorsten (DE)

(73) Assignee: Kiekert AG, Heiligenhaus (DE)

( * ) Notice: Subject to any disclaimer, the term of this patent is extended or adjusted under 35 U.S.C. 154(b) by 340 days.

(21) Appl. No.: 15/554,267

(22) PCT Filed: Feb. 10, 2016

(86) PCT No.: PCT/DE2016/100059

§ 371 (c)(1),
(2) Date: Aug. 29, 2017

(87) PCT Pub. No.: WO2016/138891

PCT Pub. Date: Sep. 9, 2016

(65) Prior Publication Data

US 2018/0080246 A1 Mar. 22, 2018

(30) Foreign Application Priority Data

Mar. 2, 2015 (DE) ..... 10 2015 100 725

(51) Int. Cl.
*E05B 15/00* (2006.01)
*E05B 15/04* (2006.01)
(Continued)

(52) U.S. Cl.
CPC ..... *E05B 15/0053* (2013.01); *E05B 15/04* (2013.01); *E05B 79/08* (2013.01); *E05B 85/02* (2013.01); *E05B 2015/0437* (2013.01)

(58) Field of Classification Search
CPC ..... E05B 2015/0493; E05B 17/0041; E05B 77/38; E05B 15/04; Y10T 292/0894
See application file for complete search history.

(56) References Cited

U.S. PATENT DOCUMENTS 2,910,318 A * 10/1959 Masur ..... E05B 85/28 292/201
2,940,788 A * 6/1960 Thorne ..... E05B 85/28 292/1
(Continued)

FOREIGN PATENT DOCUMENTS

DE 92 10 719 U1 12/1992
DE 20 2010 015 399 U1 2/2012
(Continued)

OTHER PUBLICATIONS

International Search Report and Written Opinion for corresponding Patent Application No. PCT/DE2016/100059 dated Jul. 26, 2016.
(Continued)

*Primary Examiner* — Mark A Williams
(74) *Attorney, Agent, or Firm* — Renner, Otto, Boisselle & Sklar, LLP

(57) ABSTRACT

The invention relates to a motor vehicle lock (1), comprising a lock housing (2), a lock plate, adjusting means (3, 4) which are received in the lock housing (2) and/or on the lock plate such that they can move, particularly swivel in at least in some regions, the adjusting means (3, 4) being positionable in at least two different positions (L1, L2), a spring element (5, 6), said spring element (5, 6) cooperating with the adjusting means (3, 4) in such a way that the spring element (5, 6) holds the adjusting means (3, 4) in the respective position (L1, L2), and the spring element (5, 6) being attached to the adjusting means (3, 4) such that the adjusting means (3, 4) can move together with the spring element (5, 6).

12 Claims, 2 Drawing Sheets

Figure 1:
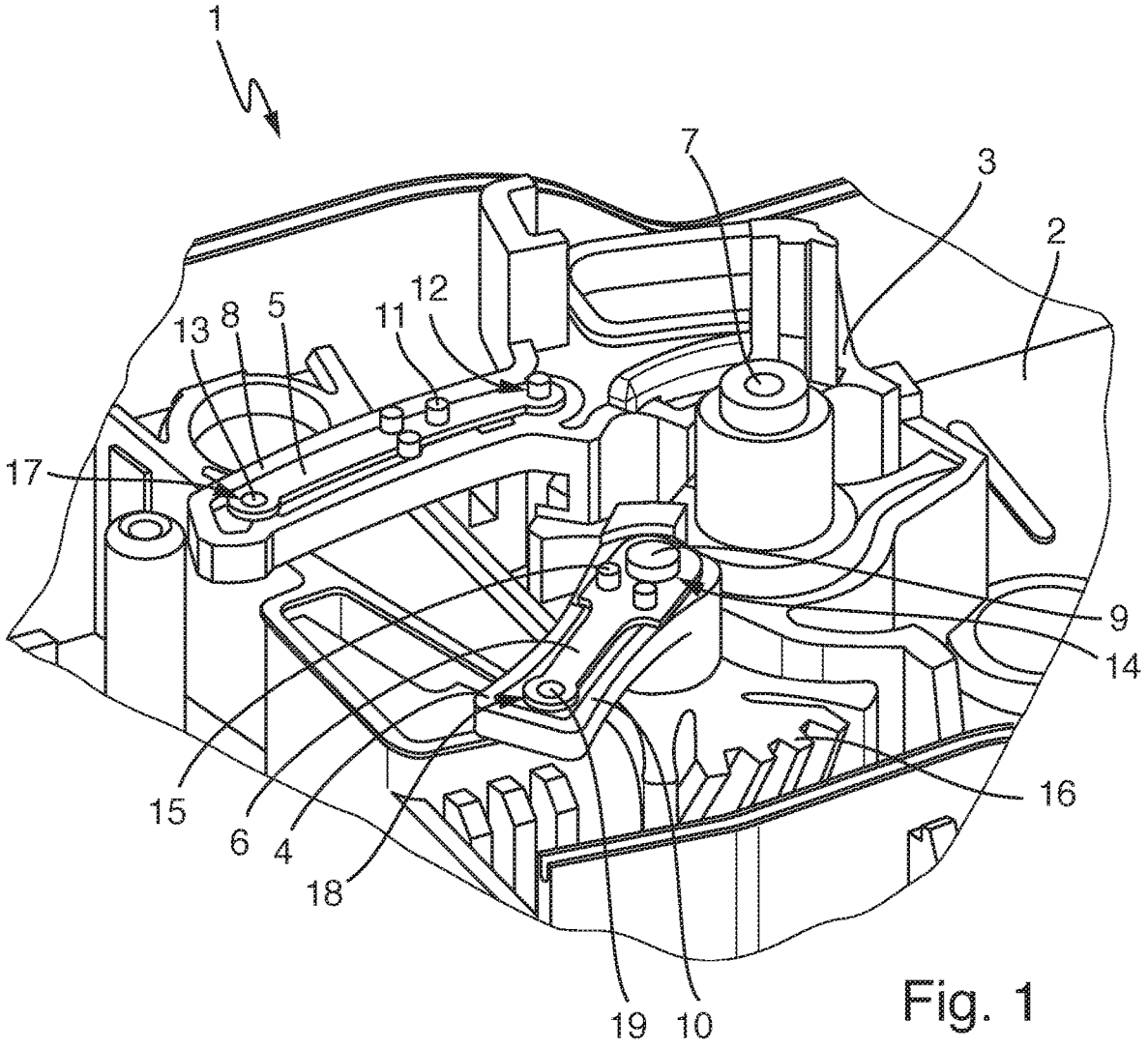

(51) Int. Cl.
*E05B 79/08* (2014.01)
*E05B 85/02* (2014.01)

(56) References Cited

U.S. PATENT DOCUMENTS

| | | | | |
|---|---|---|---|---|
| 3,823,966 | A * | 7/1974 | Torii | E05B 85/243 292/216 |
| 4,298,223 | A * | 11/1981 | Raffelsiefer | E05B 85/26 292/216 |
| 2005/0001437 | A1* | 1/2005 | Brose | E05B 85/26 292/216 |
| 2005/0140147 | A1* | 6/2005 | Spurr | E05B 85/26 292/216 |
| 2005/0206174 | A1* | 9/2005 | Fisher | E05B 83/36 292/226 |
| 2006/0267351 | A1* | 11/2006 | Spurr | E05B 81/20 292/216 |
| 2012/0161455 | A1* | 6/2012 | Meyer | E05B 85/26 292/219 |
| 2014/0312627 | A1* | 10/2014 | Frommann | E05B 83/34 292/57 |
| 2015/0097379 | A1* | 4/2015 | Spurr | E05B 85/26 292/200 |
| 2015/0345190 | A1* | 12/2015 | Dow | E05B 81/06 292/200 |
| 2017/0114574 | A1* | 4/2017 | Topfer | E05B 77/06 |

FOREIGN PATENT DOCUMENTS

| | | | |
|---|---|---|---|
| DE | 202010015399 | U1 | 4/2012 |
| DE | 202011004426 | U1 | 8/2012 |
| DE | 10 2013 000 854 | A1 | 7/2014 |
| DE | 102013000854 | A1 | 7/2014 |
| DE | 10 2013 213 934 | A1 | 1/2015 |
| EP | 1 126 107 | A1 | 8/2001 |
| JP | S61 161375 | U | 10/1986 |
| JP | H05 45175 | U | 6/1993 |

OTHER PUBLICATIONS

Search Report of DE Application No. 102015100725.8 dated Nov. 3, 2015.

* cited by examiner

MOTOR VEHICLE LOCK

The invention relates to a motor vehicle door latch having a latch housing, a latch plate, an actuator mounted in the latch housing and/or on the latch plate, in a movable, in particular areawise pivotable, whereby the actuator can be positioned in at least two different positions, a spring element, whereby the spring element interacts with the actuator in such a way that the spring element maintains the actuator in the respective position.

In order to initialize a closure or opening movement in a motor vehicle door latch, actuators are moved manually or by means of an electromotor. A manual movement can occur, for example, by means of an external door handle or an internal activation handle. Movements of the electromotor in the latch are usually undertaken with an electromotor integrated in the latch. Any initialization causes a movement of actuators, such as gearwheels, sliders or levers, to name just a few. According to initialization, i.e. initiated or assumed state of the motor vehicle latch the actuators assume different positions. These actuator positions are either fixed by means of further actuators or fixed or held in position by means of a spring according to the force acting on the actuator. The fixing or holding of an actuator in a fixed position by means of a spring is generally known.

From DE 20 2010 015 399 U1, for example, an actuator is known in the form of an angular activation lever, on the pivot axis of which a leg spring is arranged. The leg spring sits on an eccentric disk and interacts with its arms on the one hand against a fixed stop and on the other hand with the activation lever. The leg spring holds the activation lever in a fixed position against its activation direction. Furthermore, the leg spring is assigned the task of stabilizing the position respectively assumed in relation to the eccentric arrangement.

From DE 10 2013 000 854 A1, a multiple spring element has become known which is able to maintain several actuators in position. The multiple spring element is formed as a leaf spring and acts on several actuators, in particular a coupling lever, an external activation lever and a central locking lever. Starting from a mounting element, the multiple spring element has three spring arms. Two of these spring arms are equipped with a control contour which is formed as a multiple splay. A spring arm has a sharp splay, in contrast the other spring arm can be described as a curved contour. The control contours interact with actuators. The curved contour lies flatly adjacent to the external activation lever and ensures that the external activation lever returns to its starting position after activation. The component which can be described as a sharp groove interacts with an actuator in such a way that two different positions can be attained bistably. These two different positions can be attained by a contour being present on the actuator which interacts with the leg spring and interacts in such a way that two different stable positions of the actuator can be attained. The different positions are stable as, on the one hand, the contour of the actuator and on the other hand the formation of the leg spring interact in a form-fitting manner so that an independent resetting of the actuator is safely prevented.

Leg springs and also leaf springs require mounting in the motor vehicle latch and require appropriate space so that the springs can interact with the actuators. This state of the art has, in principle, proven itself.

A problem which is always present in the further development of motor vehicle latches is that, on the one hand, necessary mountings for springs require a separate construction and, on the other hand, space needs to be provided for the mounting and the interplay between the spring and the actuator.

The task of the invention is to improve a motor vehicle latch in such a way that, on the one hand, additional mountings can be dispensed with and, on the other hand, as little space as possible is required for the spring element. Furthermore, it is a task of the invention to provide a cost-effective motor vehicle latch of a simple construction.

The task is solved according to the invention by the characteristics of the independent claims. Advantageous designs of the invention are specified in the sub-claims. It is pointed out that the design examples described hereafter are not restrictive; instead, any possible variations are possible of the characteristics described in the description and the sub-claims.

According to patent claim 1, the task of the invention is solved by a motor vehicle door latch being provided, having a latch housing, a latch plate, an actuator mounted in the latch housing and/or on the latch plate in a movable, in particular at least areawise pivotable, manner, whereby the actuator can be positioned in at least two different positions, a spring element, whereby the spring element interacts with the actuator in such a way that the spring element maintains the actuator in the respective position, whereby the spring element is mounted on the actuator so that the actuator can be moved together with the spring element. By the formation of the motor vehicle latch according to the invention, the possibility is now given of providing a latch which dispenses with or can dispense with a separate mounting for the spring element and which manages with minimum space for the spring element.

The motor vehicle latch has a latch plate and a latch housing. The latch housing includes a housing lid on the one hand and also a latch housing connected to the latch plate. The latch plate is usually made of metal and surrounds the latch housing, at least on one side. The latch plate is preferably L-shaped, surrounds the latch housing at least on two sides and has an opening by means of which a latch holder can interact with a locking mechanism arranged in the motor vehicle latch. According to the stress of the components acting in the motor vehicle latch, the moving mounted components of the motor vehicle latch can be accommodated in the latch housing, latch lid and/or on the latch plate. When a movement of the actuator is spoken about in conjunction with the present invention, this includes on one hand a pivoting movement, a rotational movement and on the other hand also a shifting movement. The actuator can thus be accommodated or mounted in a linear shifting manner in the latch housing, but also in a further component of the motor vehicle latch. It is crucial for the invention that the actuator can assume at least two different positions in the motor vehicle latch. In addition to a linear movement of an actuator, for example, the actuator can also execute a pivoting or rotational movement. For this purpose, the actuator can be mounted directly or on an axis in the latch housing and/or on the latch plate.

The actuator can assume at least two different positions in the latch. The actuator is thus, for example, pivotably mounted on an axis and rotates around an angle in two different positions. Positions can then be assigned to different states in the motor vehicle. Thus, for example, an actuator can be a central locking lever which can be adjusted between the unlocked and locked positions. The actuator assumes two different end positions in relation to the central locking.

In each of these positions, the position of the actuator and in particular the safe position of the actuator must be guaranteed in order that the state of the latch set by the operator of the motor vehicle is maintained. If the central locking is now controlled by means of an electric drive, for example, then the electric drive is equipped with a non-self-inhibiting gearbox so that resetting would be possible, even without an electric drive. This would then be possible, for example, in the case of manual emergency locking. However, in order to ensure that the actuators remain in the set state and maintain their position, the spring element is arranged in such a way that the actuator retains the respective position. According to the invention, the spring element is mounted on the actuator. The spring element thus moves with the actuator, whereby no separate mounting is necessary for the actuator. Space for further components is thus created in the housing of the motor vehicle latch or the latch can have a more compact construction.

In one design form of the invention, the spring element has a fixed end and a free end, whereby the free end interacts with a further component of the motor vehicle latch. Advantageously, the spring element is mounted on the actuator in such a way that a fixed end and a free end are formed. The fixed end can be connected, for example, to the rotational axis or the actuator so that the spring element is mounted. The free end of the spring then acts, for example, against the latch housing or the latch lid or against further components in the motor vehicle latch. The free end therefore exerts force on the actuator and is able to fix or position the actuator in its position. By means of the free end, a relative force can thus be produced between the actuator and a further part or component of the motor vehicle.

If the free end of the spring element has an indentation, a further design form of the invention results. By means of an indentation, the spring element is able to connect in an interlocking manner with a further component of the motor vehicle latch and thus further secure the position of the actuator. A depression inserted into the spring, a splay or another shape formed otherwise can act as an indentation. The indentation is suitable for ensuring that the actuator experiences additional positional securing. In addition to the force-fitting connection produced by the spring between the spring element and a further component an additional form fit is thus added which maintains the actuator in its position.

If the indentation interacts with a recess and/or elevation of the further component, whereby the indentation lies adjacent with a spring effect against the further component, a further design form of the invention results. If an indentation or splay is present on the free end of the spring element, and if a recess and/or elevation is present in the further component with which the spring element interacts, the possibility is thus created to form a form fit which further ensures the position of the actuator.

Very precise positions can therefore be travelled to, especially for end positions, but also for intermediate positions. Intermediate positions are possible at will, if the actuator cannot only be moved backwards and forwards between two positions, but there is an intermediate position. An intermediate position can result, for example, if the actuator proceeds from a zero position. If the actuator is in a zero position and the spring element acts against a further component, such as the latch housing, a first position can be travelled towards from this position, for example, by a movement in the anti-clockwise direction. If, in contrast, a movement is accomplished in the clockwise direction out of the zero position, a second position can thus be travelled into so that the zero position forms an intermediate position. Furthermore, of course, any number of intermediate positions can be travelled towards or the actuator can be moved into any number of intermediate positions.

The interplay of indentation and recess and/or elevation can serve to very precisely travel towards a position or location of the actuator. This can be advantageous in particular if, in the course of wear, play is set. Thus, a secure position of the actuator can be attained by means of the form fit between the spring element and a further component.

In a further design form of the invention, the spring element is in the form of a leaf spring. If the spring element is in the form of a leaf spring, space can therefore additionally be saved. A leaf spring can be attached directly on the actuator and stretch along the actuator. Minimum space is therefore required for the actuator or the spring element connected to the actuator. A leaf spring also has the advantage that the leaf spring is extremely cost-effective which, in turn, has an advantageous impact on the price of the motor vehicle latch. Furthermore, spring characteristic curves are easy to set on leaf springs.

If the actuator has a radial extension and if the spring element on the actuator is arranged along the extension of the actuator, a further design form of the invention results. In particular, if the actuator has a radial extension, the use of a spring element arranged on the actuator can be advantageous. For example, a radial extension is given if the actuator has an extension extending from a rotational axis in a radial direction. A radial extension can also be formed from a gearwheel segment, for example. However, radial extension can also mean an extension of a sliding element only extending in one direction so that the spring element extends along the extension of the sliding element.

Starting from a central area of the sliding element which, can be shifted in a linear manner, for example, the radial extension then also extends in a sliding direction or, for example, in a curved shape along an extension of the sliding element. It must hereby be heeded that the spring element does not compulsorily need to have a straight shape, but that the spring element can also extend in an arch shape.

If the spring element is connected to the actuator in a form-fitting manner, a further advantageous design form of the invention results. Form-fitting hereby means that the spring element has an opening, for example, into which one of the axes on which the actuator is mounted engages. However, the actuator can also have a pin or mandrel or cylindrical pin in which the leaf spring can be inserted and attached on the actuator. The form fit hereby enables the spring element to be connected to the actuator with the least means. Thus, on the one hand, the position of the spring element to the actuator can be precisely specified and, at the same time, the form fit can serve for the force of the spring element being transferrable to the actuator.

Furthermore, the leaf spring can be mounted in the actuator in such a way that only the free, elastic end of the spring element which lies adjacent against the further component protrudes from the actuator and engages in a force-fitting and/or interlocking manner into the further component of the motor vehicle latch. Hereby, space continues to be saved in the motor vehicle latch and an improved design form is provided. It is also possible that two or more openings in the spring element are present so that, for example, the leaf spring can be shifted via an axis of the actuating element and a further form-fitting element is present on the actuator with which or into which the spring element interacts.

A further design form of the invention is guaranteed if the actuator is made of plastic and the spring element has openings which correspond to elevations, in particular cylindrical pins, of the actuator. The formation of the actuator from plastic offers a cost-effective possibility of manufacture of the actuator. Furthermore, it is very easily possible to form elevations on the actuator into which the spring element can be inserted. The spring element is preferably formed of spring steel; however, it can also be formed of plastic. Spring steel offers the advantage that an identical spring force can be guaranteed at all times. Furthermore, spring steels are cost-effective and can in particular be manufactured as leaf springs in a cost-effective manner.

If the further component is a housing component of the motor vehicle latch, an advantageous design form of the invention thus results. In particular if the actuator and especially the spring element on the actuator interacts with the latch housing a cost-effective design of a position securing can be executed for an actuator. Recesses and/or elevations can be formed directly on the latch housing which then interact with the spring element on the actuator. The advantage is hereby attained that no further components are required to attain position securing.

If the housing section has depressions which interact with the indentations of the spring element, the position of the actuator is thus determinable in the motor vehicle latch. Depressions on a latch housing section, such as a latch housing or a latch lid, can interact with indentations on the spring element so that an extremely cost-effective alternative results for safe positioning of the actuator. In addition to the force fit, a form fit is available which can be set on a force acting on the actuator according to the formation of the indentation. The form of the depression on the indentation can be set so that certain determination of the position of the actuator is possible by means of the selected form fit.

Hereafter, the invention is explained in further detail with reference to the adjacent drawings on the basis of preferred design forms. However, the principle applies that the design example does not restrict the invention but only constitutes an advantageous design form. The characteristics depicted can be executed individually or in combination with other characteristics of the description, as also the patent claims individually or in combination.

Figure 2:
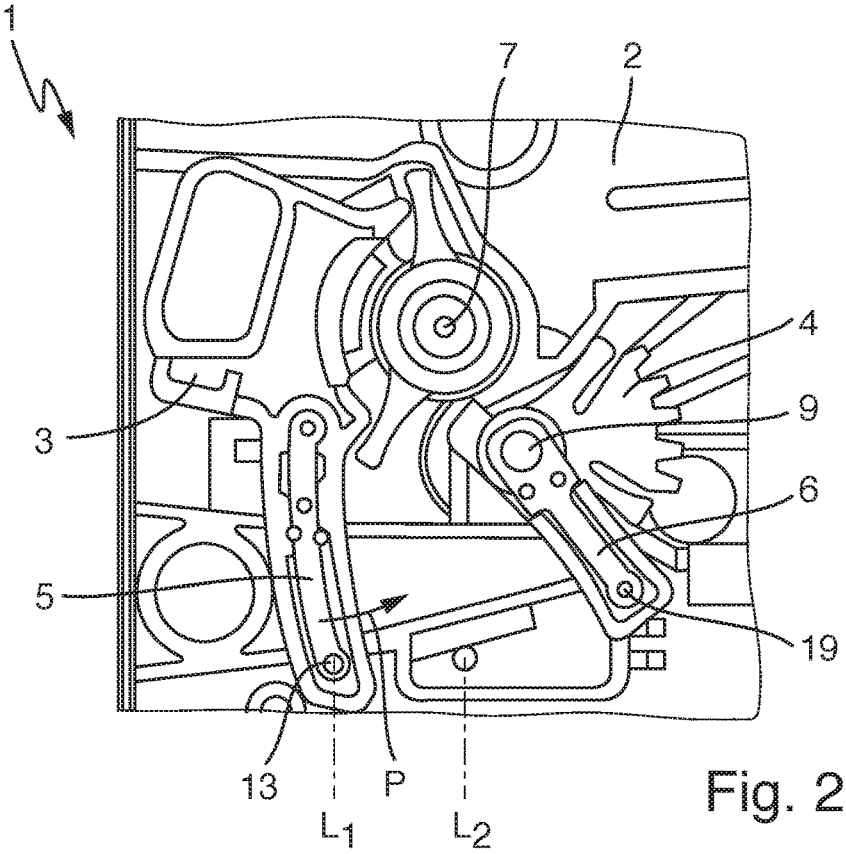
Figure 3:
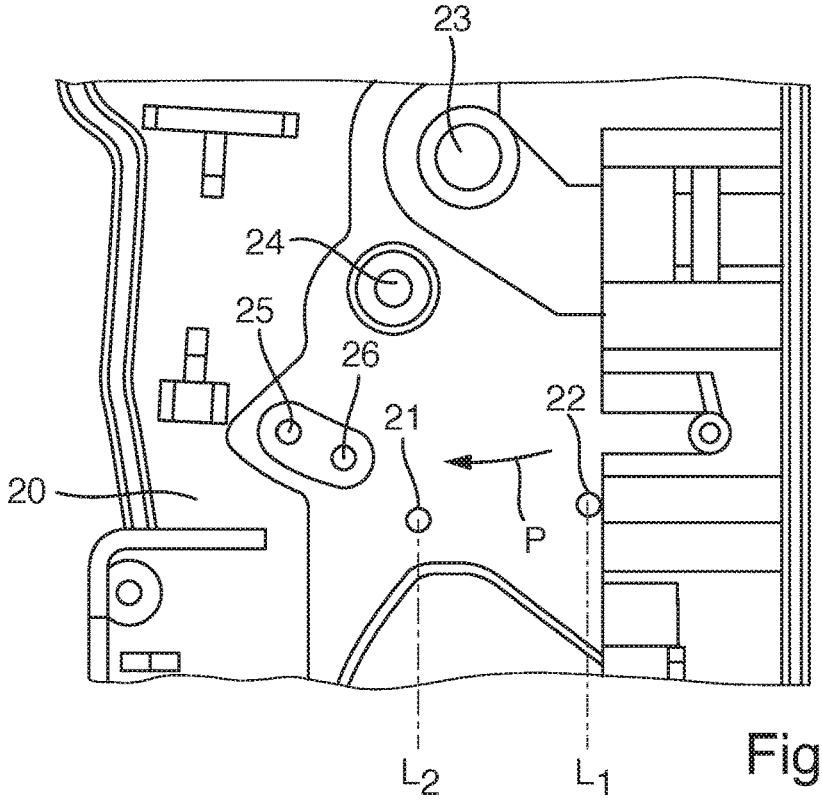

The following are shown:

FIG. 1 a three-dimensional view of components, in particular actuators, of an open motor vehicle latch, FIG. 2 a top view of the opened and only partially illustrated motor vehicle latch according to FIG. 1, and FIG. 3 an internal view of a housing lid of the motor vehicle latch depicted in FIG. 1 as a section in the area of the moving actuators.

FIG. 1 shows a motor vehicle latch 1 in an opened illustration with a latch housing 2, a first actuator 3, a second actuator 4, a first spring element 5 and a second spring element 6. The first actuator 3 is pivotably accommodated on an axis 7 and has an extension 8 which extends in a radial direction from the axis 7 in a direction away from the rotational axis 7. The second actuator 4 is also mounted on an axis 9 and also has a radial extension 10 which extends away from the axis 9. Both actuators 3, 4 are pivotably mounted in the latch housing 2. For improved clarification of the invention, the illustration of further components in the motor vehicle latch 1 was dispensed with.

The first actuator 3 can be a central locking lever 3, for example, whereby the first actuator 3 can be moved in at least two different positions, such as bolted or unbolted. A first spring element 5 is mounted on the radial extension 8 of the first actuator 3, whereby the first spring element 5 can be mounted on the first actuator 3 by means of cylinder pins 11 molded onto the actuator 3. The cylinder pins serve for mounting and position securing of the first spring element 5 on the first actuator 3.

For the further securing of the first spring element 5 the cylinder pins preferably made of plastic can be heat-embossed, for example. The spring element 5 can be indetachably connected to the actuator 3 by means of heat embossing. The cylinder pins 11 also serve to precisely align the spring element 5 to the actuator 3. The spring element 5 has an indentation 13 at the free end of the spring element 5. The indentation can be inserted, for example, as a circular depression, for example, by means of a reshaping of the spring element 5 into the spring element 5. The form-fitting mounting of the spring element 5 in the actuator 3 is also clearly apparent in FIG. 1.

In contrast to the first actuator 3, the second actuator 4 is equipped with a spring element 6 which is directly attached to the axis 9 of the actuator 4. To this end, the spring element 6 is inserted into an opening 14 so that the spring element 6 is joinable by means of the axis 9 of the actuator 4. In addition, cylindrical pins 15 are formed on the actuator, into which the second spring element 6 can be inserted. The cylindrical pins 15 serve, together with the opening 14, to secure the position of the spring element 6, whereby the cylindrical pins 15 can also be heat-embossed or molded by means of heat embossing so that an indetachable connection can be attained.

The axis 9 can, for example, also be a metallic axis which is connected to a non-illustrated latch case. However, it is also conceivable that the axes 7, 9 for the actuators 3, 4 are formed as a single component with the latch housing 2, for example, are manufactured by means of injection molding. The axes 7, 9 are then connected as a single component with the latch housing 2.

It is apparent that the second actuator 4 is mounted in a pivotable manner in the motor vehicle latch, which is apparent on the gearwheel segment 16 serving to drive the actuator 4. The other components necessary for the drive, such as a wormgear and an electromotor, are not illustrated for the better illustration of the inventive idea.

The areas of the spring elements 5, 6 equipped with the openings 12, 14 are firmly connected to the actuators 3, 4. The free ends 17, 18 of the spring elements 5, 6 point away from the actuator 3, 4 and are able to interact with a further, non-illustrated, component of the motor vehicle latch 1. The indentations 13, 19 of the spring elements 5, 6 can interact in a form-fitting manner into, for example, a depression of a further component, such as a latch lid.

FIG. 2 shows a top view of the motor vehicle latch 1 according to FIG. 1 in a top view. The first actuator 3, the second actuator 4, the first spring element 5 and the second spring element 6 are shown. The actuators 3, 4 are mounted around the axes 7, 9 in a pivotable manner in the latch housing 2.

For example, an arrow P is inserted into FIG. 2 to illustrate an anti-clockwise direction movement of the actuator 3 around the axis 7. If the actuator 3 and in particular the indentation 13 of the actuator 3 are located in position LI, the actuator 3 thus moves in the direction of the arrow P into a position L2.

In FIG. 3, a latch lid 20 is illustrated which interacts with the spring element 5. To this end, depressions 21, 22 are molded into the latch lid 20 which interact with the indentation 13. Starting from position LI the indentation 13 interacts with the depression 22 and after an adjustment of the actuator 2 in the direction of the arrow P the indentation 13 engages in the end position with the depression 21. The spring element 5 thus not only interacts with the latch lid 20 in a force-fitting manner, but is also held in an interlocking manner in the latch lid 20 so that the position is stabilized and securing is improved. The axis mounting 23 for the axis 7 of the actuator 3 is also recognized. The axis mounting 24 is also illustrated. In the movement of the actuator 3 in the direction of the arrow B the spring element 5 moves from the position LI via the latch lid 20 into position L2. The actuator 4 also executes a comparable movement, whereby the second spring element 6 and in particular the indentation 19 also interacts with the latch lid 20. The indentation 19 then engages with the depressions 25, 26, for example.

LIST OF REFERENCE SYMBOLS

1 Motor vehicle latch
2 Latch housing
3 first actuator
4 second actuator
5 first spring element
6 second spring element
7 axis
8 extension
9 axis
10 extension
11 cylindrical pins
12 opening
13 indentation
14 opening
15 cylindrical pins
16 gearwheel segment
17, 18 free end
19 indentation
20 latch lid
21, 22 depressions
23, 24 axis mounting
25, 26 depressions
P arrow
Ll position 1
L2 position 2

The invention claimed is:

1. A motor vehicle latch comprising:
a latch housing,
a latch plate,
an actuator pivotably mounted in the latch housing and/or on the latch plate whereby the actuator can be positioned in at least two different positions, and
a spring element, the spring element interacting with the actuator in such a way that the spring element maintains the actuator when the actuator is in each of the at least two different positions, and
wherein the spring element is attached to the actuator so that the actuator can be moved together with the spring element, wherein the spring element has a free end and a fixed end that is fixed to the actuator, wherein the spring element extends along the actuator from the fixed end to the free end such that the actuator and spring element function as an integral and compact unit, allowing for ease of and simplification during assembly.

2. The motor vehicle latch according to claim 1, wherein the free end interacts with a further component of the motor vehicle latch.

3. The motor vehicle latch according to claim 2, wherein the free end of the spring element has an indentation that is engageable with the further component.

4. The motor vehicle latch according to claim 3, wherein the indentation interacts with a recess and/or elevation of the further component, wherein the indentation and the recess and/or elevation are engageable in a form-fitting manner.

5. The motor vehicle latch according to claim 1, wherein the spring element is executed in the form of a leaf spring.

6. The motor vehicle latch according to claim 1, wherein the actuator has a radial extension that extends from a rotational axis of the actuator and the spring element is arranged on the actuator along the extension of the actuator.

7. The motor vehicle latch according to claim 1, wherein the spring element is connected in a form-fitting manner with the actuator.

8. The motor vehicle latch according to claim 1, wherein the actuator is made of plastic and the spring element has openings which correspond to elevations of the actuator for securing the spring element to the actuator.

9. The motor vehicle latch according to claim 1, wherein the further component is a housing component of the motor vehicle latch.

10. The motor vehicle latch according to claim 9, wherein the housing component has depressions which interact with indentations on the spring element so that the position of the actuator can be determined in the motor vehicle latch.

11. The motor vehicle latch according to claim 8, wherein elevations are cylindrical pins.

12. A motor vehicle latch comprising:
a latch housing,
a latch plate,
an actuator pivotably mounted in the latch housing and/or on the latch plate, whereby the actuator can be positioned in at least two different positions, and
a spring element, the spring element interacting with the actuator in such a way that the spring element maintains the actuator when the actuator is in each of the at least two different positions, and
wherein the spring element is attached to the actuator so that the actuator can be moved together with the spring element, wherein the spring element has a free end and a fixed end that is fixed to the actuator,
wherein the free end interacts with a further component of the motor vehicle latch, and
wherein the actuator is made of plastic and the spring element has openings which correspond to elevations of the actuator for securing the spring element to the actuator such that the actuator and spring element function as an integral and compact unit, allowing for ease of and simplification during assembly.

* * * * *